US005765710A

United States Patent [19]

Bergerioux

[11] Patent Number: 5,765,710

[45] Date of Patent: Jun. 16, 1998

[54] PACKAGING CONTAINER AND METHOD OF FORMING THE SAME

[75] Inventor: Claude Bergerioux, Tokyo, Japan

[73] Assignee: Tetra Laval Holdings & Finance S.A., Switzerland

[21] Appl. No.: 586,714

[22] PCT Filed: Aug. 23, 1994

[86] PCT No.: PCT/JP94/01390

§ 371 Date: Jan. 29, 1996

§ 102(e) Date: Jan. 29, 1996

[87] PCT Pub. No.: WO95/05983

PCT Pub. Date: Mar. 2, 1995

[30] Foreign Application Priority Data

Aug. 23, 1993 [JP] Japan ..... 5-207773

[51] Int. Cl.[6] ..... B65D 23/08

[52] U.S. Cl. ..... 220/453; 220/468; 156/185

[58] Field of Search ..... 220/453, 468; 156/185, 187, 188

[56] References Cited

U.S. PATENT DOCUMENTS 4,604,307 8/1986 Spreeuwers ..... 220/453
4,702,390 10/1987 Rinkovsky, Sr. ..... 220/453
4,766,019 8/1988 Michaels et al. ..... 220/453
5,238,715 8/1993 Wefers et al. ..... 220/453

FOREIGN PATENT DOCUMENTS 86-141176 10/1981 Japan .
2-185422 7/1990 Japan .

*Primary Examiner*—Joseph M. Moy
*Attorney, Agent, or Firm*—Lorusso & Loud

[57] ABSTRACT

A packaging container includes a holding container thermoformed from a multi-layer sheet made of a resin, a lid made of resin and adapted for sealing the holding container, and an exterior covering surrounding the exterior of the holding container and made of a non-metallic material having a hardness and a thermal insulating performance higher than those of the holding container. Since no metal is used in the packaging container, the packaging container can be easily crushed after being thrown away, and the collection of the packaging container can be made easier. Since the holding container and the lid are made of resin and the exterior covering is made of a non-metallic material, food in the packaging container can be directly heated by dielectric heating. According, the food can be heated to a sufficient temperature within a short time. Moreover, since the exterior covering has a good thermal insulating performance, the packaging container can be held by hand even immediately after being taken out from a vending machine, and the food held therein is prevented from quickly getting cold.

16 Claims, 7 Drawing Sheets

PACKAGING CONTAINER AND METHOD OF FORMING THE SAME

TECHNICAL FIELD

The present invention relates to a packaging container and a method of manufacturing the same.

BACKGROUND ART

Conventionally, bottles, paper containers, metallic cans, etc., have been used as packaging containers for holding foods such as liquid foods. These packaging containers are sealed after predetermined amounts of liquid foods are charged therein, and are then sold.

Such package containers in the form of bottles are not suitable for sale using vending machines because they are weak against impacts and are easily broken. Although paper containers are suitable for sale using vending machines because they are not broken by impacts, their flexibility is too high. Therefore, when a paper container is opened, it may be deformed so that liquid food held therein flows out from the spout of the container. Moreover, the liquid food held in the container cannot been seen through the container.

In contrast, metallic cans are suitable for sale using vending machines because they are strong against impacts and have a sufficient hardness.

However, conventional metallic cans have problems in that a difficulty exists in crushing thrown-away empty cans, and that laborious work is needed to separately collect aluminum cans and steel cans.

In the case where liquid foods are sold by a vending machine after being heated therein, metallic cans must be indirectly heated using hot air, because metallic cans cannot be directly heated by dielectric heating. Accordingly, it takes a prolonged time to heat liquid foods to a proper temperature. In addition, due to the poor thermal insulating performance of metallic cans, a metallic can cannot be held by hand immediately after being taken out from a vending machine. Also, liquid food held therein gets cold in a short period of time.

In view of the foregoing problems of conventional metallic cans, it is an object of the present invention to provide a packaging container which can be easily collected after use, which allows liquid food to be heated by dielectric heating, and which has an excellent thermal insulating performance. Another object of the present invention is to provide a method of forming the package container as set forth above.

DISCLOSURE OF THE INVENTION

A packaging container according to the present invention comprises a holding container formed by deforming a multi-layer sheet made of a resin according to a thermoforming method, a lid made of a resin and adapted for sealing the holding container, and an exterior covering surrounding the exterior of the holding container and made of a non-metallic material having a hardness and a thermal insulating performance higher than those of the holding container.

Since no metal is used in the packaging container, the packaging container can be easily crushed after being thrown away, facilitating the collection of the packaging container.

Also, since the holding container and the lid are made of resin and the exterior covering is made of a non-metallic material, the packaging container can be directly heated by dielectric heating in the case where food held in the packaging container is heated in a vending machine before being sold. Accordingly, the food can be heated to a sufficient temperature within a short time.

Moreover, since the exterior covering has a good thermal insulating performance, the packaging container can be held by hand even immediately after being taken out from a vending machine, and the food held therein is prevented from quickly getting cold.

In another packaging container according to the present invention, a forward-end expansion method is employed as the thermoforming method. In this case, a holding container is formed which is well balanced in wall thickness, and has bottom and side walls which are thin and uniform. In addition, the holding container can be made lighter, and the air tightness can be increased.

In a method according to the present invention for forming a packaging container, a holding container is formed by deforming a multi-layer sheet made of a resin according to a thermoforming method such that the holding container is formed in an exterior covering made of a non-metallic material having a high hardness and a good thermal insulating performance. At this time, the multi-layer sheet is heated and thereby sterilized due to the thermal formation. The holding container is prevented from contraction or deformation which would otherwise occur due to the effect of molecular orientation during a retorting process.

Subsequently, food is charged into the holding container, which is then sealed with a lid made of a resin.

In another method according to the present invention for forming a packaging container, a holding container is formed by deforming a multi-layer sheet made of a resin according to a thermoforming method. At this time, the multi-layer sheet is heated and thereby sterilized due to the thermal formation. In addition, the holding container is prevented from contraction or deformation which would otherwise occur due to the effect of molecular orientation during a retorting process.

Subsequently, the exterior of the holding container is surrounded by an exterior covering made of a non-metallic material having a hardness and a thermal insulating performance both higher than those of the holding container. The holding container is sealed with a lid made of a resin after food is charged into the holding container.

In still another method according to the present invention for forming a packaging container, a holding container is formed by deforming a multi-layer sheet made of a resin according to a thermoforming method. At this time, the multi-layer sheet is heated and thereby sterilized due to the thermal formation. In addition, the holding container is prevented from contraction or deformation which would otherwise occur due to the effect of molecular orientation during a retorting process.

Subsequently, the holding container is sealed with a lid made of a resin after food is charged into the holding container. The exterior of the holding container is then surrounded by an exterior covering made of a non-metallic material having a hardness and a thermal insulating performance both higher than those of the holding container.

In still another method according to the present invention for manufacturing a packaging container, a forward-end expansion method is employed as the thermoforming method. In this case, a holding container is formed which is well balanced in wall thickness, and has bottom and side walls which are thin and uniform. In addition, the holding container can be made lighter, and the air tightness can be increased.

BEST MODE FOR CARRYING OUT THE INVENTION

Embodiment of the present invention will next be described in detail with reference to the drawings.

Figure 1:
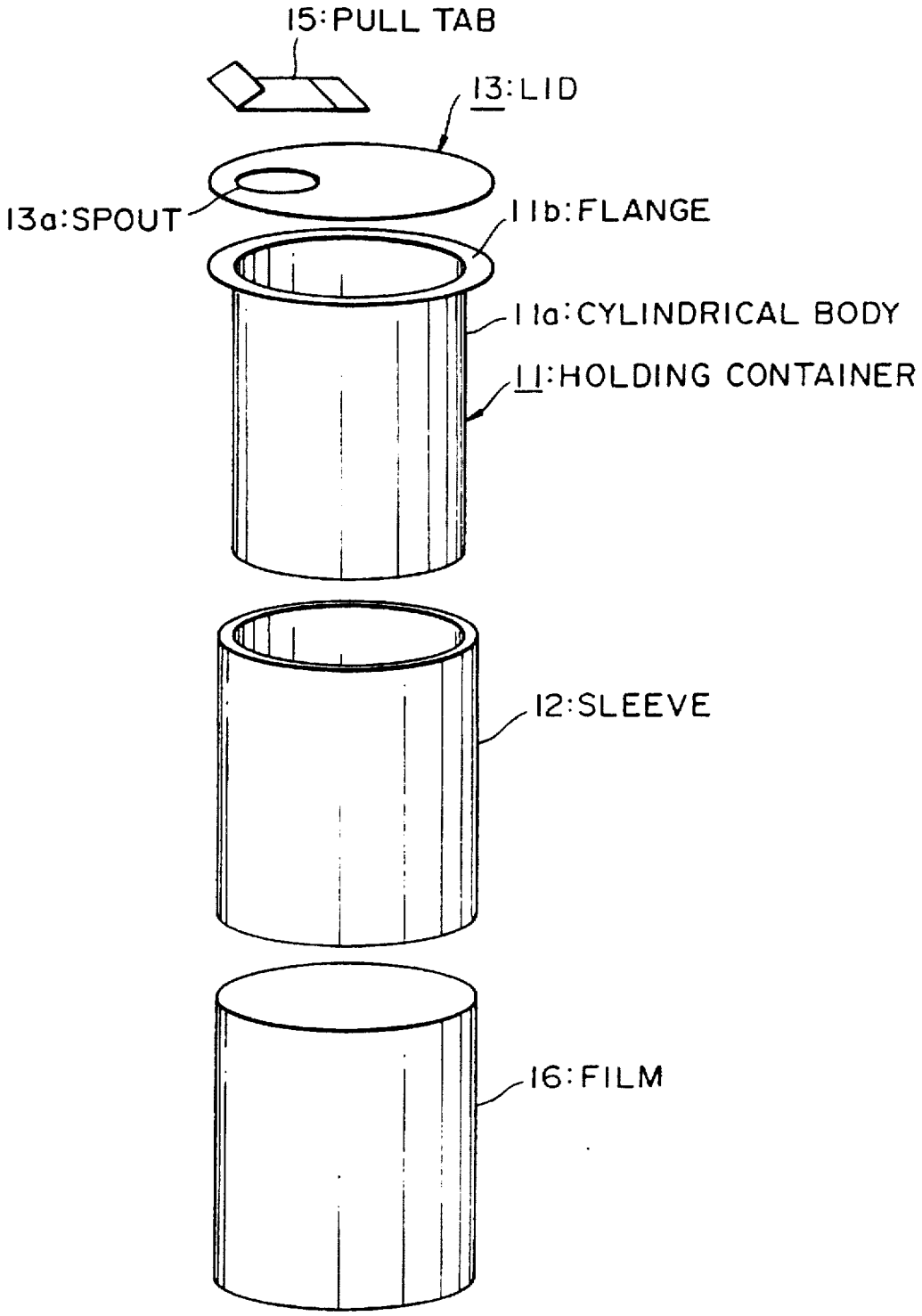
FIG. 1 is an exploded perspective view of a packaging container of an embodiment of the present invention.
Figure 2:
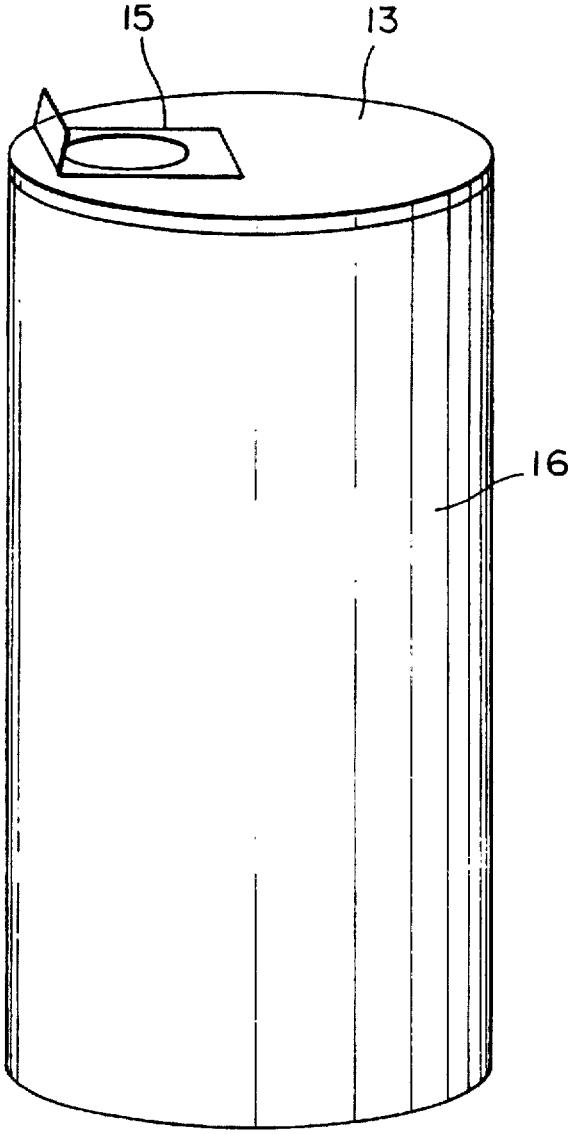
FIG. 2 is a perspective view of the packaging container of FIG. 1.

FIG. 1 is an exploded perspective view of a packaging container showing an embodiment of the present invention, and FIG. 2 is a perspective view of the packaging container showing the embodiment of the present invention.

In these drawings, numeral 11 denotes a holding container which is made of a transparent thermoplastic resin having a high gas barrier performance and which holds liquid food as food. The holding container 11 has a cup-like shape having an opening at its upper end. The holding container 11 is made of a multi-layer resin sheet which is formed by a co-extrusion method, a blown film forming method or the like, and is formed into a cup-like shape by a thermoforming method such as a forward-end expansion method which will be described later. The holding container 11 thus formed is composed of a cylindrical body 11*a* having a bottom, and a flange 11*b* extending radially outward from the upper end of the cylindrical body 11*a*. The cylindrical body 11*a* has a thickness of about 100 μm.

In the above-described forward-end expansion method, the multi-layer sheet is formed after being heated to a temperature of about 180° C. which is above the melting point. Therefore, the holding container 11 does not need to be sterilized before filling with liquid food. The holding container 11 does not contract or deform due to the effect of molecular orientation effect during a retorting process. As the thermoforming method, a vacuum blow forming, pressure blow forming, and the like may be employed.

The multi-layer sheet may have the following layered structure, for example:

PP/adhesive layer/EVOH/adhesive layer/recycled PP.

Alternatively, one of the following layered structures may be employed:

PP/recycled PP/adhesive layer/EVOH/adhesive layer/recycled PP/PP;

PP/recycled PP/adhesive layer/EVOH/adhesive layer/APET;

EVA/EVOH/EVA;

PS/EVOH/PE;

PS/EVOH/PS;

PP/EVOH/PP.

Since EVOH is included in the layered structures, to enhance the gas barrier performance of the multi-layer sheet.

Moreover, the following layered structures may be employed.

PS/PE

PS/PETG

PS/PE/PS

The exterior of the holding container 11 is covered by a sleeve 12 which serves as an exterior covering and which is made of a material having a hardness and a heat insulating performance higher than those of the holding container 11. The sleeve 12 has a tubular shape and is adapted to maintain the shape of the holding container 11 and to provide heat insulation for preventing movement of heat between the liquid food held in the holding container 11 and outside air. A cylindrical tube having a bottom may be used in stead of the sleeve 12.

The holding container 11 and the sleeve 12 form a double-wall structure. The sleeve 12 is first formed. Subsequently, the holding container 11 is formed in the sleeve 12 by a thermoforming method. The holding container 11 is sealed with a lid 13 after being filled with liquid food.

Also, the following process may be employed: The holding container 11 is formed by a thermoforming method, and is then inserted into the sleeve 12. The holding container 11 is sealed with the lid 13 after being filled with liquid food.

Moreover, the following process may be employed: The holding container 11 is formed by a thermoforming method, and is sealed with the lid 13 after being filled with liquid food. The holding container 11 is then inserted into the sleeve 12.

The sleeve 12 is made of foamed polypropylene. In this case, the diameter of each bubble formed by foaming is set to be about 150 μm.

Instead of foamed polypropylene, a layered structure comprising a polypropylene layer and a foamed polypropylene layer or a paper material may be utilized. In such a case, printing can be performed on the surface of the polypropylene layer or the paper material. In the case where the sleeve 12 is made of a transparent material, the liquid food held in the holding container 11 can be seen from the outside through the sleeve 12.

After the liquid food is charged into the holding container 11, the lid 13 is attached to the upper surface of the flange 11*b* so that the holding container 11 is sealed. The lid 13 is made of a transparent resin film having a high gas barrier performance, and is fixed to the flange 11*b* by heat sealing, ultrasonic sealing, or the like. Since the resin film is transparent, the liquid food held in the holding container 11 can be seen from the outside. In the case where the sleeve 12 is made of a transparent material, the lid 13 does not need to be made of a transparent resin film, because the liquid food held in the holding container 11 can be seen from the outside through the sleeve 12.

The resin film is formed to have a thickness of 30–50 μm by co-extrusion, blown film forming, or the like. A resin film formed by co-extrusion has the following structure, for example:

PP/adhesive layer/EVOH/adhesive layer/PP.

The lid 13 may be made of a transparent resin plate having a high gas barrier performance. The resin plate is formed by a heat press method or an injection molding method.

A spout 13*a* is formed in the lid 13 at a predetermined position for pouring the liquid food out of the holding container 11, and is sealed by a pull tab 15. The pull tab 15 is made of a material having a high gas barrier performance, a high hardness, and a high tensile strength, and may be colored.

The pull tab 15 has the following layered structure, for example:

biaxial stretching PP/peelable adhesive layer.

Formed on the exterior of the sleeve 12 is a film 16 made of a material which has a property of contracting due to heat and has gloss. Predetermined letters and a drawing are printed on the film 16. A stretching PP thinner than 20 μm may be used as the film 16. In the case where printing is performed on the surface of the sleeve 12, the film 16 is not necessary.

Since no metal is used in the packaging container, the packaging container can be easily crushed after being thrown away, facilitating the collection of the packaging container.

Also, since the holding container 11 and the sleeve 12 are made of non-metallic materials, the packaging container can be directly heated by dielectric heating in the case where liquid food held in the packaging container is heated in a vending machine before being sold. According, the liquid food can be heated to a sufficient temperature within a short time.

Moreover, the sleeve 12 has a good thermal insulating performance, the packaging container can be held by hand even immediately after being taken out from a vending machine, and the liquid food held therein is prevented from quickly getting cold.

Next, a method of forming packaging containers according to the present invention will be described.

Figure 3:
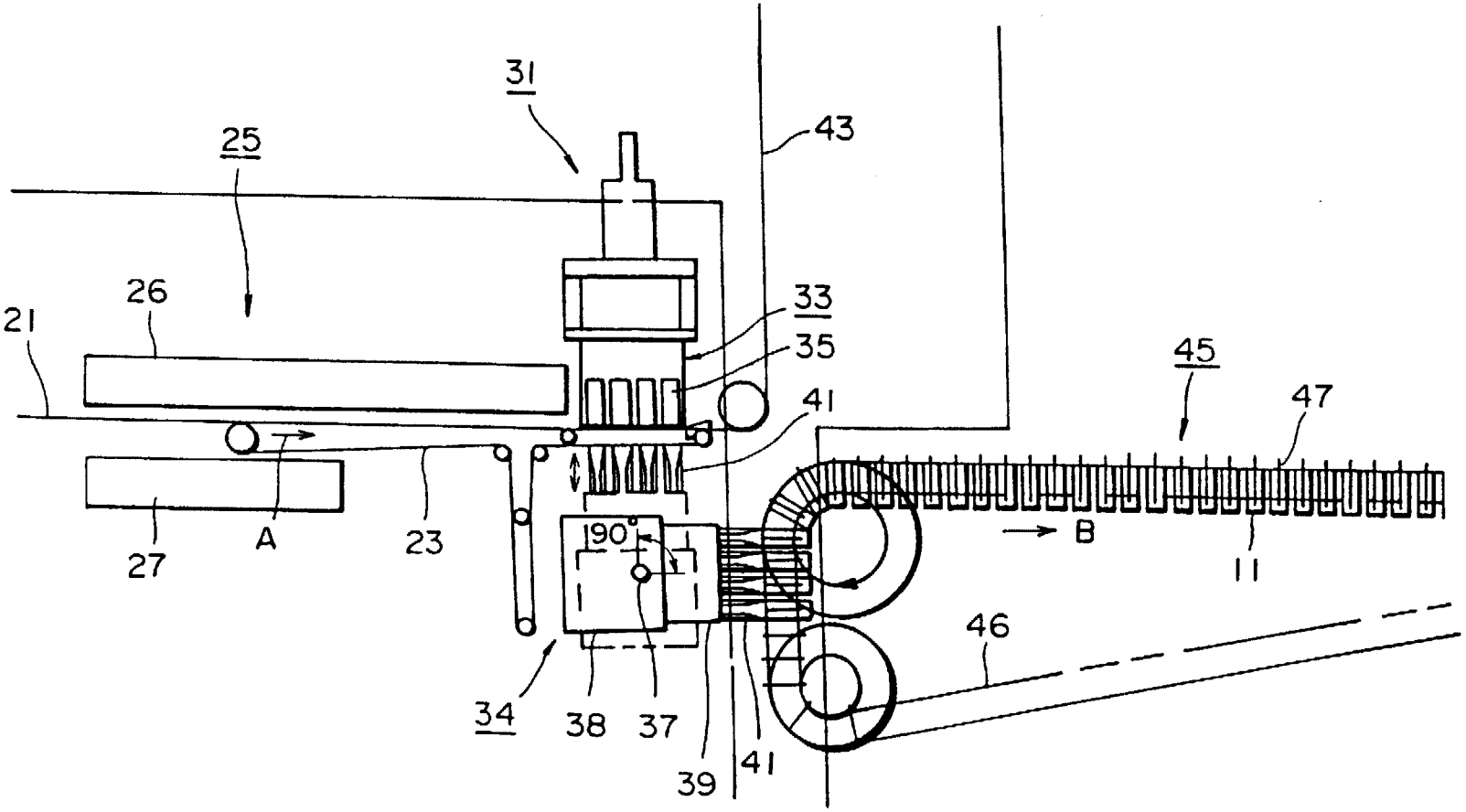
FIG. 3 is a view showing an apparatus for manufacturing packaging containers according to an embodiment of the present invention.
Figure 6:
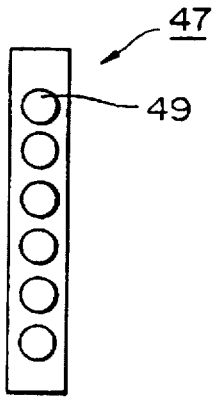
FIG. 6 is a plan view of a slat used in the apparatus for manufacturing packaging containers according to an embodiment of the present invention.

FIG. 3 is a view showing an apparatus for manufacturing packaging containers according to an embodiment of the present invention, and FIG. 6 is a plan view of a slat used in the apparatus for manufacturing packaging containers according to the embodiment of the present invention.

In FIG. 3, numeral 21 denotes a multi-layer sheet 21 which has not been subjected to thermoforming yet and which has a thickness of about 100 μm. The multi-layer sheet 21 is conveyed by a web support conveyer 23 in the direction of arrow A. Numeral 25 denotes a heating device for heating the multi-layer sheet 21 and is composed of an oven top 26 and an oven bottom 27 which faces the oven top 26, thereby forming a clearance therebetween. The multi-layer sheet 21 is heated to about 180° C., which is above the melting point, while being conveyed between the oven top 26 and the oven bottom 27.

A thermoforming apparatus 31 is disposed on the downstream side of the heating device 25 as viewed in the conveying direction. The thermoforming apparatus 31 thermally forms the multi-layer sheet 21 by a forward-end extension method to obtain holding containers 11 each having a cup-like shape. The thermoforming apparatus 31 is composed of an upper unit 33 and a lower unit 34. The upper unit 33 has a plurality of female dies 35 arranged in a plurality of lines and each having an opening facing downward. In this embodiment, four groups of lined female dies 35 are arranged in the conveying direction and each group is composed of six female dies 35. However, the number of the groups each forming a line, and the number of the female dies 35 forming each group may be changed if necessary.

The lower unit 34 includes a frame 38 supported for turning movement about a shaft 37, and an arm 39 disposed on the frame 38 for advancing and retracting movement with respect to the frame 38. A plurality of forward-end expansion plugs 41 are disposed on the arm 39 such that they face the female dies 35. According, when the frame 38 is rotated such that the forward-end expansion plugs 41 face the upper unit 33 and the arm 39 is then advanced, the forward-end expansion plugs 41 enter the female dies 35 as the arm 39 advances.

At this time, the multi-layer sheet 21 is deformed by the forward-end expansion plugs 41 so that a plurality of cylindrical bodies 11*a* each having a cup-like shape (shown in FIG. 1) corresponding to the outside shape of each forward-end expansion plug 41 are formed. Subsequently, the sheet 21 is cut along flanges 11*b* to obtain a plurality of holding containers 11.

The arm 39 is retracted in the state where the holding containers 11 are supported by the forward-end expansion plugs 41, and the frame 38 is then rotated by 90 degrees about the shaft 37. As a result, the holding containers 11 are rotated together with the forward-end expansion plugs 41 while being supported by the forward-end expansion plugs 41. Scrap sheet 43 which is left after the cutting of the holding containers 11 from the multi-layer sheet 21 is conveyed to an unillustrated grinder and is shredded there.

A slat conveyer 45 is disposed at such a location that the frame 38 faces the slat conveyer 45 after the above-described rotation of 90 degrees. The slat conveyer 45 has a plurality of slats 47 disposed along a drive chain 46, which runs in the direction of arrow B. In this embodiment, each slat 47 has six support holes 49, each of which supports one holding container 11 (See FIG. 6).

An unillustrated nozzle is disposed in each forward-end expansion plug 41. When the support holes 49 are moved to positions corresponding to the positions of the holding containers 11 supported by the forward-end extension plugs 41, air is jetted into the interior of each of the holding containers 11 through the nozzle so that the holding containers 11 are transported to the slat conveyer 45 and loaded into the support holes 49.

The holding containers 11 supported by the support holes 49 are conveyed by the slat conveyer 45 to an unillustrated filling machine. After liquid food is charged into the holding containers 11, the holding containers 11 are sealed with lids 13. Subsequently, the holding containers 11 holding liquid food are tightly inserted to the sleeves 12.

In the above-described embodiment, the holding container 11 is formed by a thermoforming method, and is sealed with the lid 13 after being filled with liquid food. The holding container 11 is then inserted into the sleeve 12.

In a second method for forming packaging containers according to another embodiment of the present invention, the sleeve 12 is first formed. Subsequently, the holding container 11 is formed in the sleeve 12 by a thermoforming method. The holding container 11 is sealed with a lid 13 after being filled with liquid food.

Figure 4:
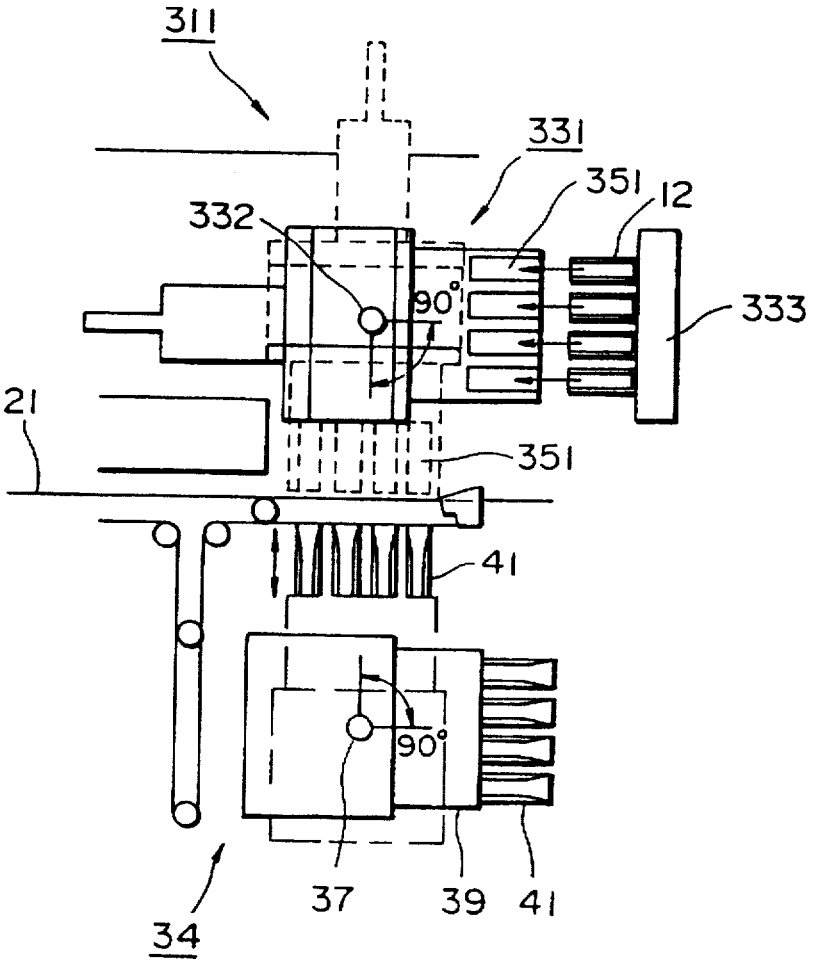
FIG. 4 is a view showing a manufacturing apparatus to which a method of forming packaging containers according to another embodiment of the present invention is applied.

FIG. 4 is a view showing a manufacturing apparatus to which a method of forming packaging containers according to another embodiment of the present invention is applied.

In FIG. 4, numeral 311 denotes a thermoforming apparatus which is composed of an upper unit 331 and a lower unit 34. The upper unit 331 is supported for turning movement about a shaft 332 and has a plurality of female dies 351 arranged in a plurality of lines and each having an opening facing downward.

The lower unit 34 includes a frame 38 supported for turning movement about a shaft 37, and an arm 39 disposed on the frame 38 for advancing and retracting movement with respect to the frame 38. A plurality of forward-end expansion plugs 41 are disposed on the arm 39 such that they face the female dies 351.

Accordingly, when the upper unit 331 is rotated such that the female dies 351 face the lower unit 34, the frame 38 is rotated such that the forward-end expansion plugs 41 face the upper unit 33 and the arm 39 is then advanced, and the forward-end expansion plugs 41 enter the female dies 351 as the arm 39 advances.

At this time, the multi-layer sheet 21 is deformed by the forward-end expansion plugs 41 so that a plurality of cylindrical bodies 11*a* each having a cup-like shape (shown in FIG. 1) corresponding to the outside shape of each forward-end expansion plug 41 are formed. Subsequently, the sheet 21 is cut along flanges 11*b* to obtain a plurality of holding containers 11.

In the present embodiment, the sleeves 12 are previously inserted into the female dies 351 before the rotation of the upper unit 331. Accordingly, the holding containers 11 can be formed in the sleeves 12. For this purpose, a sleeve inserting apparatus 333 is disposed at a sleeve inserting position of the upper unit 331.

The arm 39 is retracted in the state where the holding containers 11 are supported by the forward-end expansion plugs 41, and the frame 38 is then rotated by 90 degrees about the shaft 37. As a result, the holding containers 11 and the sleeves 12 are rotated together with the forward-end expansion plugs 41 while being supported by the forward-end expansion plugs 41.

A slat conveyer 45 (shown in FIG. 1) is disposed at such a location that the frame 38 faces the slat conveyer 45 after the above-described rotation of 90 degrees. The slat conveyer 45 has a plurality of slats 47 disposed along a drive chain 46, and each of support holes 49 (FIG. 6) of the slats 47 supports the holding container 11 and the sleeve 12.

An unillustrated nozzle is disposed in each forward-end expansion plug 41. When the support holes 49 are moved to positions corresponding to the positions of the holding containers 11 supported by the forward-end extension plugs 41, air is jetted into the interior of each of the holding containers 11 through the nozzle so that the holding containers 11 and the sleeves 12 are transported to the slat conveyer 45 and loaded into the support holes 49.

The holding containers 11 and the sleeves 12 supported by the support holes 49 are conveyed by the slat conveyer 45 to an unillustrated filling machine. After liquid food is charged into the holding containers 11, the holding containers 11 are sealed with lids 13.

In a third method for forming packaging containers according to still another embodiment of the present invention, the holding container 11 is formed by a thermoforming method, and is then inserted into the sleeve 12. Subsequently, the holding container 11 is filled with liquid food, and is sealed with the lid 13.

Figure 5:
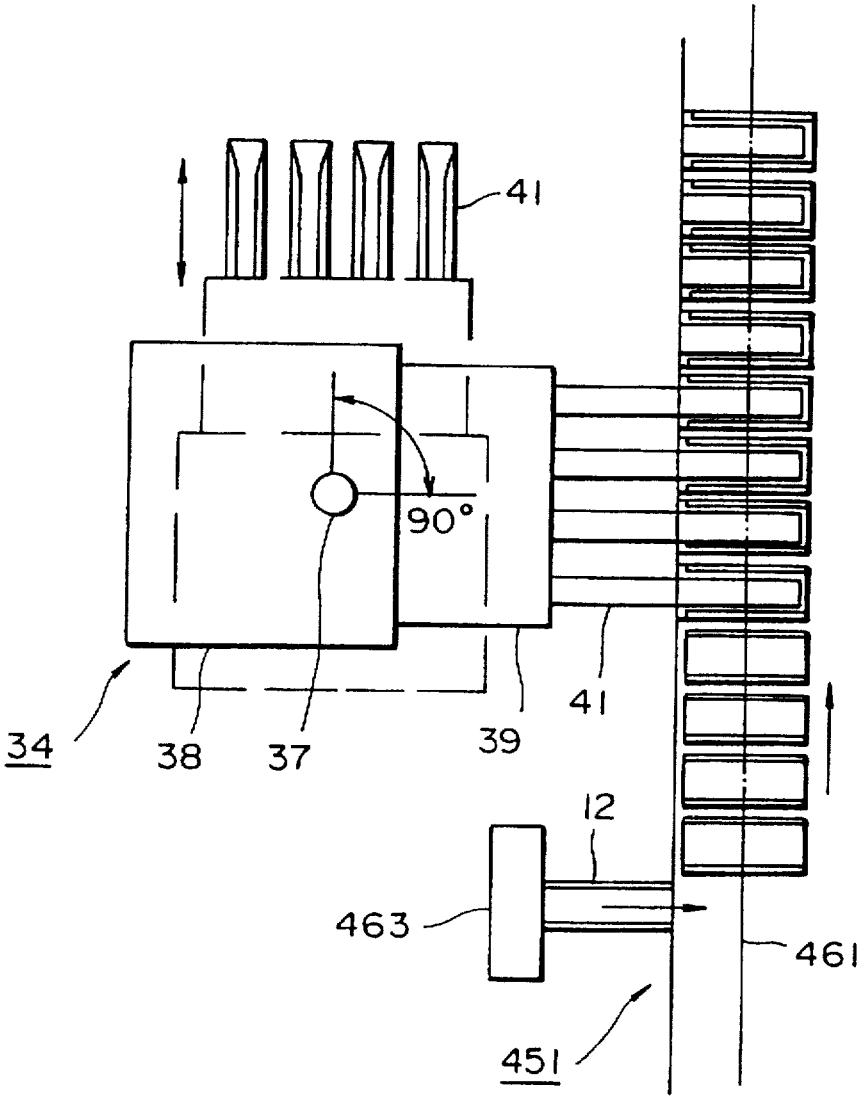
FIG. 5 is a view showing a manufacturing apparatus to which a method of forming packaging containers according to still another embodiment of the present invention is applied.

FIG. 5 is a view showing a manufacturing apparatus to which a method of forming packaging containers according to still another embodiment of the present invention is applied.

In FIG. 5, numeral 34 denotes a lower unit and numeral 33 denotes an upper unit (shown in FIG. 3) facing the lower unit 34. The upper unit 33 has a plurality of female dies 35 arranged in a plurality of lines and each having an opening facing downward.

The lower unit 34 includes a frame 38 supported for turning movement about a shaft 37, and an arm 39 disposed on the frame 38 for advancing and retracting movement with respect to the frame 38. A plurality of forward-end expansion plugs 41 are disposed on the arm 39 such that they face the female dies 35.

Accordingly, when the frame 38 is rotated such that the forward-end expansion plugs 41 face the upper unit 33 and the arm 39 is then advanced, the forward-end expansion plugs 41 enter the female dies 35 as the arm 39 advances.

At this time, the multi-layer sheet 21 is deformed by the forward-end expansion plugs 41 so that a plurality of holding containers 11 are formed.

The arm 39 is retracted in the state where the holding containers 11 are supported by the forward-end expansion plugs 41, and the frame 38 is then rotated by 90 degrees about the shaft 37. As a result, the holding containers 11 are rotated together with the forward-end expansion plugs 41 while being supported by the forward-end expansion plugs 41.

A slat conveyer 451 is disposed at such a location that the frame 38 faces the slat conveyer 451 after the above-described rotation of 90 degrees. The slat conveyer 451 has unillustrated slats disposed along a drive chain 461, and support holes of the slats support the holding containers 11 and sleeves 12.

Moreover, a sleeve inserting apparatus 463 which inserts the sleeves 12 into the support holes of the slats is disposed on the upstream side in the running direction of the slat conveyer 45 with respect to the position at which the slat conveyer 45 faces the frame 38.

An unillustrated nozzle is disposed in each forward-end expansion plug 41. When the support holes 49 are moved to positions corresponding to the positions of the holding containers 11 supported by the forward-end extension plugs 41, air is jetted into the interior of each of the holding containers 11 through the nozzle so that the holding containers 11 are transported to the slat conveyer 45 and loaded into the sleeves 12 previously inserted into the support holes of the slats.

The holding containers 11 and the sleeves 12 supported by the support holes are conveyed by the slat conveyer 45 to an unillustrated filling machine. After liquid food is charged into the holding containers 11, the holding containers 11 are sealed with lids 13 (shown in FIG. 1).

Next, a description will be given of the forward-end expansion method.

Figure 7:
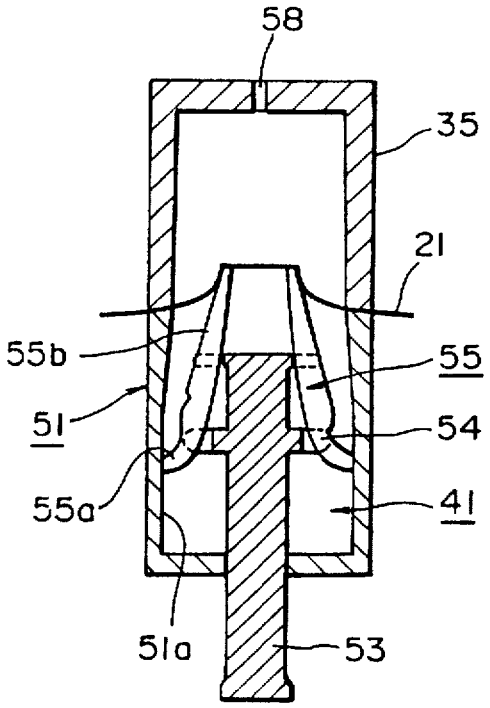
FIG. 7 is a view showing a first step of a first method of forming packaging containers according to an embodiment of the present invention.
Figure 8:
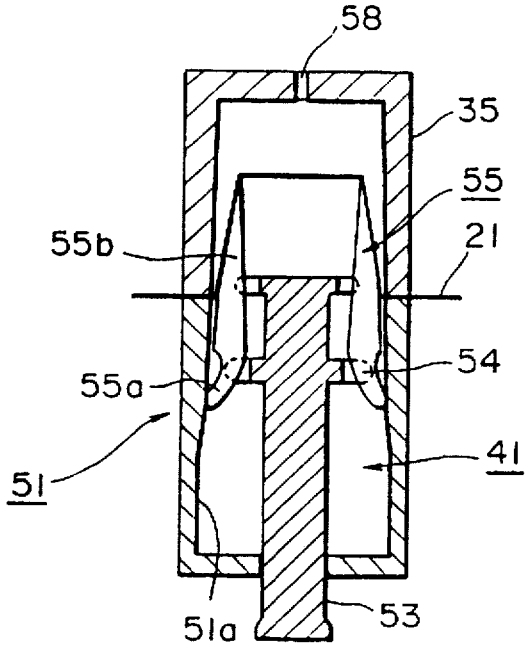
FIG. 8 is a view showing a second step in the first method embodiment of forming packaging containers according to the present invention.
Figure 9:
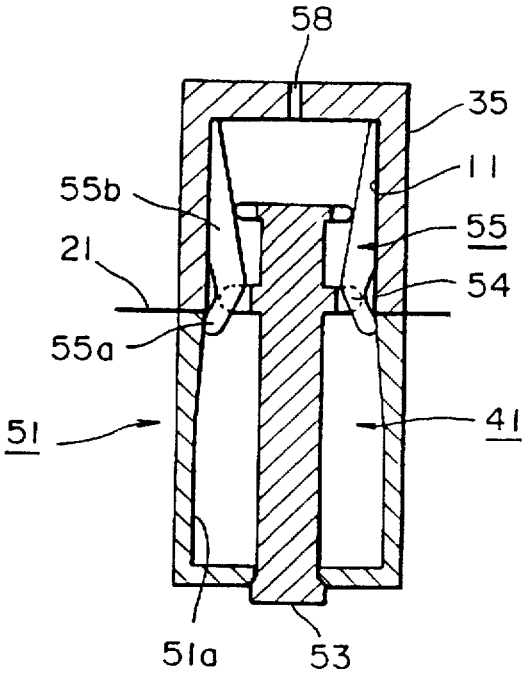
FIG. 9 is a view showing a third step in the first method embodiment of forming packaging containers according to the present invention.

FIG. 7 is a view showing a first step of a method of forming packaging containers according to an embodiment of the present invention, FIG. 8 is a view showing a second step of the method of forming packaging containers according to the embodiment of the present invention, and FIG. 9 is a view showing a third step of the method of forming packaging containers according to the embodiment of the present invention.

In FIGS. 7–9, numeral 21 denotes a multi-layer sheet, numeral 35 denotes a female die, and numeral 41 denotes a forward-end expansion plug. The forward-end expansion plug 41 is disposed facing the female die 35, and comprises an cylindrical expansion cam 51 having a bottom and an opening facing the female die 35, a rod 53 disposed for vertical movement at the center of the forward-end expansion plug 41, and cam blades 55 attached to the forward-end of the rod 53 for pivoting movement about the support points 54. The cam blades 55 are disposed along the periphery edge of the rod 53, and each blade 55 is composed of a cam following portion 55*a* located on the downward side of the support point 54 and an extending portion 55*b* located on the upward side of the support point 54.

On the inner surface of the expansion cam 51, a cam surface 51*a* is formed such that the diameter of the cam surface 51*a* is gradually reduced toward the upper end. Accordingly, when the rod 53 is elevated, as shown in FIG. 8, the cam following portions 55*a* of the cam blades 55 are moved along the expansion cam 51 and are gradually displaced in radially inward directions, so that the cam blades 55 pivot. As a result, the forward ends of the expanding portions **55*b* are moved in radially outward directions as the cam blades 55 pivot. During this operation, a vacuum is created in the interior of the female die 35 by evacuating air therefrom through a hole 58 formed in the female die 35**.

In this manner, a holding container 11 is formed which is well balanced in wall thickness, and has bottom and side walls which are both thin and uniform. In addition, the holding container 11 can be made lighter, and the air tightness can be increased.

The present invention is not limited to the above-described embodiments. Numerous modifications and variations of the present invention are possible in light of the spirit of the present invention, and they are not excluded from the scope of the present invention.

I claim:

1. A packaging container comprising:

(a) a holding container thermoformed from a multi-layer sheet wherein at least two of the layers are made of different resins;

(b) a lid made of a resin and adapted for sealing closed said holding container and having an opening therein for discharge of contents of the holding container;

(c) a removable pull tab for sealing said opening closed;

(d) an exterior covering surrounding the exterior of said holding container and made of a non-metallic material having a hardness and a thermal insulating performance higher than those of said holding container.

2. A packaging container according to claim 1, in which said holding container is thermoformed by a forward-end expansion method.

3. A method for forming a packaging container comprising the steps of:

(a) forming a holding container by thermoforming, within a resin sleeve, a multi-layer sheet wherein at least two of the layers of the sheet are made of different resins, whereby said resin sleeve forms an exterior covering, made of a non-metallic material having a high hardness and a good thermal insulating performance, around said holding container;

(b) filling said holding container with a foodstuff; and then (c) sealing closed the filled holding container with a resin lid.

4. A method for forming a packaging container comprising the steps of:

(a) forming a holding container by thermoforming a multi-layer sheet wherein at least two of the layers of the sheet are made of different resins;

(b) surrounding the exterior of the holding container with an exterior covering made of a non-metallic material having a hardness and a thermal insulating performance both higher than those of the holding container;

(c) filling said holding container with a foodstuff; and then (d) sealing closed the filled holding container with a resin lid.

5. A method for forming a packaging container comprising the step of:

(a) forming a holding container by thermoforming a multi-layer sheet wherein at least two of the layers of the sheet are made of different resins;

(b) filling the holding container with a foodstuff; then (c) sealing the filled holding container with a resin lid; and (d) surrounding the exterior of the holding container with a resin sleeve to form an exterior covering made of a non-metallic material having a hardness and a thermal insulating performance both higher than those of the holding container.

6. A method according to claim 3, in which said thermoforming method is a forward-end expansion method.

7. A method according to claim 4, in which said thermoforming method is a forward-end expansion method.

8. A method according to claim 4, in which said thermoforming method is a forward-end expansion method.

9. A packaging container according to claim 1 further comprising:

(e) a heat shrink film fitted over said exterior covering.

10. A packaging container according to claim 1 wherein said exterior covering comprises at least one layer of a polypropylene foam.

11. A packaging container according to claim 1 wherein said multi-layer sheet is formed entirely of resin layers.

12. A packaging container according to claim 1 wherein said multi-layer sheet includes a gas barrier layer.

13. A packaging container according to claim 12 wherein said gas barrier layer is EVOH.

14. A method according to claim 3 further comprising:

(d) covering said exterior covering with a heat-shrink film.

15. A method according to claim 4 further comprising:

(f) covering said exterior covering with a heat-shrink film.

16. A method according to claim 5 further comprising:

(e) covering said exterior covering with a heat-shrink film.

* * * * *